US005544971A

United States Patent [19]

Huege et al.

[11] Patent Number: 5,544,971

[45] Date of Patent: Aug. 13, 1996

[54] METHODS AND COMPOSITIONS FOR RECYCLING ASPHALT PAVEMENT

[75] Inventors: Fred R. Huege, Colleyville; Patrick Shields, Scottsdale, both of Tex.

[73] Assignee: Chemical Lime Company, Fort Worth, Tex.

[21] Appl. No.: 380,945

[22] Filed: Jan. 31, 1995

Related U.S. Application Data

[63] Continuation-in-part of Ser. No. 329,436, Oct. 26, 1994, Pat. No. 5,512,093.

[51] Int. Cl.[6] ..... F01C 21/00; F01C 23/12

[52] U.S. Cl. ..... 404/72; 404/75; 404/77; 404/91

[58] Field of Search ..... 404/72, 75, 76, 404/90, 91, 92, 77, 79; 106/284.04, 793, 792

[56] References Cited

U.S. PATENT DOCUMENTS

| | | | |
|---|---|---|---|
| 783,570 | 2/1905 | Ellis et al. . | |
| 1,095,180 | 4/1914 | Carson | 106/793 |
| 1,277,855 | 9/1918 | Carson . | |
| 1,579,766 | 4/1926 | Hite . | |
| 1,664,598 | 4/1928 | Dittlinger . | |
| 2,044,553 | 6/1936 | Welch . | |
| 2,192,284 | 3/1940 | Dahlberg . | |
| 3,732,023 | 5/1973 | Rank et al. | 404/92 X |
| 3,912,678 | 10/1975 | Azar et al. | 106/284.04 X |
| 4,175,975 | 11/1979 | MacWilliams et al. | 106/100 |
| 4,226,552 | 10/1980 | Moench | 404/75 X |
| 4,272,212 | 6/1981 | Bauer, Jr. et al | 404/72 |
| 4,329,090 | 5/1982 | Teague et al. . | |
| 4,453,856 | 6/1984 | Chiostri et al. | 404/92 X |
| 4,464,353 | 8/1984 | Hains . | |
| 4,465,518 | 8/1984 | Miyoshi et al. | 106/89 |
| 4,473,320 | 9/1984 | Register | 404/92 X |
| 5,401,312 | 3/1995 | Hanst | 404/76 X |

*Primary Examiner*—Michael P. Buiz
*Assistant Examiner*—James A. Lisehora
*Attorney, Agent, or Firm*—Charles Gunter, Jr.

[57] ABSTRACT

A method is shown for recycling asphalt pavement. A high solids lime slurry is prepared by either slaking quicklime or by slurrying dry, hydrated lime. The high solids lime slurry is mixed with crushed aggregate which has been collected by scraping the top surface of an old roadway. The treated aggregate is deposited onto the old roadway and compacted to form a new roadway.

12 Claims, 2 Drawing Sheets

METHODS AND COMPOSITIONS FOR RECYCLING ASPHALT PAVEMENT

BACKGROUND OF THE INVENTION

This application is a continuation-in-part of earlier filed Ser. No. 08/329,436, filed Oct. 26, 1994, now U.S. Pat. No. 5,512,093, entitled "Hot Mix Asphalt And Method Of Preparation Thereof."

FIELD OF THE INVENTION

The present invention relates generally to the use of high solids lime slurry for recycled asphalt pavement and, more specifically, to the use of high solids lime slurry for cold-in-place or hot-in-place road construction.

DESCRIPTION OF THE PRIOR ART

Old and deteriorating asphalt paved roads, and in particular those which overlay an unstable clay subgrade, have long presented maintenance and reconstruction problems. There are many reasons for the gradual deterioration of such roadways including heavy or prolonged traffic, heavy loads being transported and the effects of climate, to name a few. An unstable subgrade makes the problem even worse because of clay penetrating the aggregate base, making the base prone to failure.

While the pavement and base can be excavated, hauled away for disposal and replaced with new base, this is an expensive procedure. It is also possible to place new hot mix asphalt over the existing road surface. This alternative has the drawback of increasing the height of the road surface, however.

Recycled asphalt pavement (RAP) presents a more economical alternative which does not necessarily increase the height of the road surface. In both cold-in-place and hot-in-place RAP processes, the damaged top several inches of the road surface are broken up and scarified. The broken up surface is then ground to a small and uniform aggregate size and rejuvenators and/or new asphalt binder is added. The rejuvenated mixture is deposited on the road surface and compacted to form a new road surface. This was sometimes accomplished in one continuous operation with a large road paving machine or in several separate steps. Both cold-in-place and hot-in-place processes take place at or on the roadway being serviced by special machines that perform all the necessary functions as they move down the roadway. Lime addition forms a valuable function in the rejuvenation process since the lime reacts with fugitive clay in the rejuvenated base to stabilize it into a much stronger base. See, Chemistry and Technology of Lime and Limestone, Boynton, 2nd Edition 1980, pg. 472.

While the use of cold-in-place or hot-in-place recycled asphalt pavement has been known since at least the 1930–1940 time period, it has found limited utilization for the resurfacing of old asphalt roads. A major reason for its limited utilization involves certain shortcomings associated with the use of dry hydrated lime as the lime source for the rejuvenant. Dry hydrated lime, calcium hydroxide, is a well established additive for hot mix asphalt pavement. It improves anti-stripping, reduces cracking and age hardening. It has similar benefits when used with cold-in-place or hot-in-place recycled asphalt pavement. However, the use of dry hydrated lime is difficult or impossible to incorporate into the aggregate asphalt mix when a continuous operation is used. Hydrated lime is a very fine particle size material that when mixed dry will have substantial amounts of dust formed especially when mixed in a non-enclosed mixer, as would be the case with RAP technology. Additionally, mixing the 1–2% dry hydrated lime with the milled recycled asphalt pavement prior to the addition of the asphalt binder does not lend itself to uniform mixing and activation of the aggregate surface by the lime.

The above noted deficiencies present in RAP processes using dry hydrated lime can be eliminated by the use of high solids lime slurry instead of dry hydrated lime. The high solids lime slurry can be prepared by either slaking quicklime or by slurrying dry, hydrated lime. High solids, greater than 30% by weight, lime slurry can be added to the milled recycled asphalt pavement at several points between just prior to the initial processing of the road surface to just prior to the addition of the asphalt binder to the recycled aggregate. By having a tank on the paving machine or a tank truck moving synchronous with the milling machine used in the RAP process, high solids lime slurry can be pumped into the pulverization zone of the milling machine and uniformly coat the aggregate as it is crushed to its proper particle size. This liquid-solid mixing provides much greater uniformity than dry solid-dry mixing. In addition to its well established benefits, adding lime slurry in this application also helps break down the emulsion, imparts early strength, and reduces milling costs.

An additional advantage to using high solids lime slurry for the present application is the property of the high solids lime slurry to act as a lubricant to the teeth of the machine that performs the initial scrapping off or pulverization of the road surface. By placing a slurry distribution bar at the front of the scraping machine and distributing the lime slurry on the road surface, the lime slurry acts as a lubricant between the metal teeth of the scraping machine and the asphalt pavement. By placing the lime slurry at this point in the operation, maximum mixing of the recycled asphalt pavement and the lime is achieved.

The present invention has as its principal object to eliminate the previously mentioned shortcomings with RAP processes using dry hydrated lime by providing a high solids lime slurry instead of dry hydrated lime for use in the processes.

Another object of the invention is to provide a slurry produced from quicklime or from dry, hydrated lime for treating the aggregate component which slurry has a higher percent solids than was previously available.

Another object of the invention is to provide an improved method for treating the pulverized aggregate used in RAP processes with a hot slurry prepared from quicklime rather than from dry hydrate.

Another object of the invention is to produce such an improved slurry from quicklime which has an increased temperature over hydrated lime slurries which can be added hot to the aggregate to cause increased evaporation of water.

Another object of the invention is to provide such a hot slurry having a lower viscosity, thus providing improved uniformity and mixing of the Ca(OH)2 particles in the slurry with the recycled aggregate.

Another object of the invention is to provide a method for adding lime slurry in a RAP process, either at the job site or at a central plant, which eliminates the silos and material handling equipment necessary to mix dry hydrated lime at the job site.

Another object is to provide a method for supplying lime slurry in a RAP process in which more precise metering of the correct amount of lime is achieved than was possible in processes in which dry hydrated lime was blended at the job site.

Another object of the invention is to provide a method for supplying lime slurry to a RAP process in which the lime slurry is prepared on site and supplied on a continuous basis.

SUMMARY OF THE INVENTION

The present invention meets the previous objects by adding a high solids lime slurry to the recycled asphalt pavement at any of several points between just prior to the initial processing of the road surface to just prior to the addition of the asphalt binder to the pulverized aggregate.

By having a tank on a paving machine or a tank truck moving synchronously with the milling machine used in the surfacing operation, a high solids lime slurry can be pumped into the pulverization zone of the milling machine to uniformly coat the aggregate as it is crushed to its proper particle size. This liquid-solid mixing provides much greater uniformity than did dry—solid mixing. The high solids lime slurry can be prepared by either slaking quicklime or by slurrying hydrated lime. The lime component is mixed together with an aqueous medium in a mixing tank to form the slurry. The resulting slurry has a lime solids content greater than about 30% by weight, based upon the total weight of the slurry.

The step of forming the slurry can include the additional step of adding a soluble sulfate compound to the slaking medium used to form the slurry. The aqueous slaking medium is preferably water and the soluble sulfate compound is preferably a member selected from the group consisting of alkali metal and alkaline earth sulfates, organic sulfates, sulfuric acid and mixtures thereof. Also, organic dispersants such as sodium polyacrylates can be added to the water prior to slaking or after slaking to lower the viscosity and increase the solids content of the slurry.

The high solids lime slurry of the invention can also be used as a lubricant for the teeth of the machine which performs the initial scraping off or pulverization of the road surface being treated. By placing a slurry distribution bar at the front of the treatment machine and distributing the lime slurry on the road surface at the moment the teeth scrape off several inches of road surface, the lime slurry acts as a lubricant between the metal teeth and the asphalt pavement. By placing the lime slurry at this point in the operation, maximum mixing of the recycled asphalt pavement and the lime is achieved.

Additional objects, features and advantages will be apparent in the written description which follows.

DETAILED DESCRIPTION OF THE INVENTION

Figure 1:
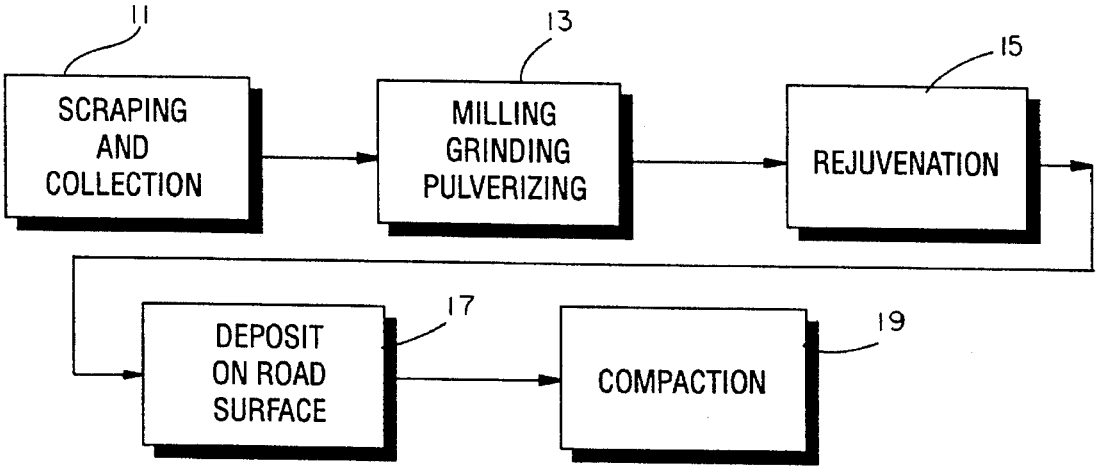
FIG. 1 (PRIOR ART)
FIG. 1 is a block diagram of a typical RAP process of the type toward which the present invention is directed.

FIG. 1 is a block diagram illustrating the common steps involved in a typical recycled asphalt pavement (RAP) process. The old road surface is first scraped or scarified in a step 11 by a special machine adapted for that purpose to a depth of several inches. Such machines are well known in the art and have been in use for a number of years. The collected aggregate material is passed in a step 13 to a milling machine which pulverizes the aggregate and grinds it to a small and uniform particle size. The ground aggregate is then passed to a rejuvenator step 15 where rejuvenators and/or new asphalt binder is combined with the aggregate. The mixture is then deposited on the roadway in the step 17 and compacted with the existing surface in a step 19 to form the new road surface. These steps are preferably accomplished in one continuous operation with a large road paving machine.

The present invention provides an improved method for supplying the lime component which is used as a rejuvenator in step 15 of the process. The lime component is supplied in the form of a high solids lime slurry, rather than in the form of dry, hydrated lime.

In the discussion which follows, the term "quicklime" will be taken to mean calcium oxide and should not be confused with limestone (calcium carbonate). Quicklime is manufactured from limestone by heating to remove carbon dioxide. The remaining calcium oxide, called quicklime, is a very active chemical. To improve its handling characteristics, a controlled amount of water is often added to form calcium hydroxide, which is commonly called "hydrated" lime or hydrate. However, as has been mentioned, dry hydrated lime is not suitable for the purposes of the present invention. Since it is a very fine particle size material, when mixed dry it produces substantial amounts of dust. Additional problems include the lack of uniform mixing and activation of the aggregate surface. Thus, if dry, hydrated lime is used as a starting material, it must be mixed with water to form an aqueous slurry in order to be useful within the context of the present invention.

There are a number of advantages to be obtained in using quicklime as the starting material for the slurries of the present invention and its use will be first discussed. Quicklime can be mixed with an aqueous slaking medium to form a hot quicklime slurry. The term "slurry" will be taken to mean a colloidal suspension form of lime which has the consistency of thick cream. Unlike putty, it has no body or plasticity. It will flow and is pumpable, like a viscous liquid. It can be obtained by adding an extra increment of water when quicklime is slaked, usually about 1 part quicklime to about 2 parts water by weight. For purposes of the present invention, the hot quicklime slurry will contain greater than about 30% by weight lime solids, based upon the total weight of slurry.

Portable equipment for forming lime slurries which can be moved from site to site, such as that described in U.S. Pat. No. 4,329,090 and which is hereby incorporated by reference, are known in the art. The portable mixing device shown in this issued patent can be used to slake quicklime or to slurry dry, hydrated lime. One of the advantages of using portable equipment is that hot lime slurries formed at the job site by the slaking of quicklime can be used almost immediately, before any significant temperature drop.

One of the shortcomings of the existing equipment such as that shown in U.S. Pat. No. 4,329,090 is that the equipment produces lime slurries in individual batches. After one batch of lime slurry has been depleted, another batch must be made on site. This can take several minutes to several hours, delaying the supply of lime slurry. Often it is crucial to have a continuous, uninterrupted supply of lime slurry. In the preferred method of the present invention, for example, special machines perform each of the necessary recycling functions as the machines move down the roadway.

Figure 3:
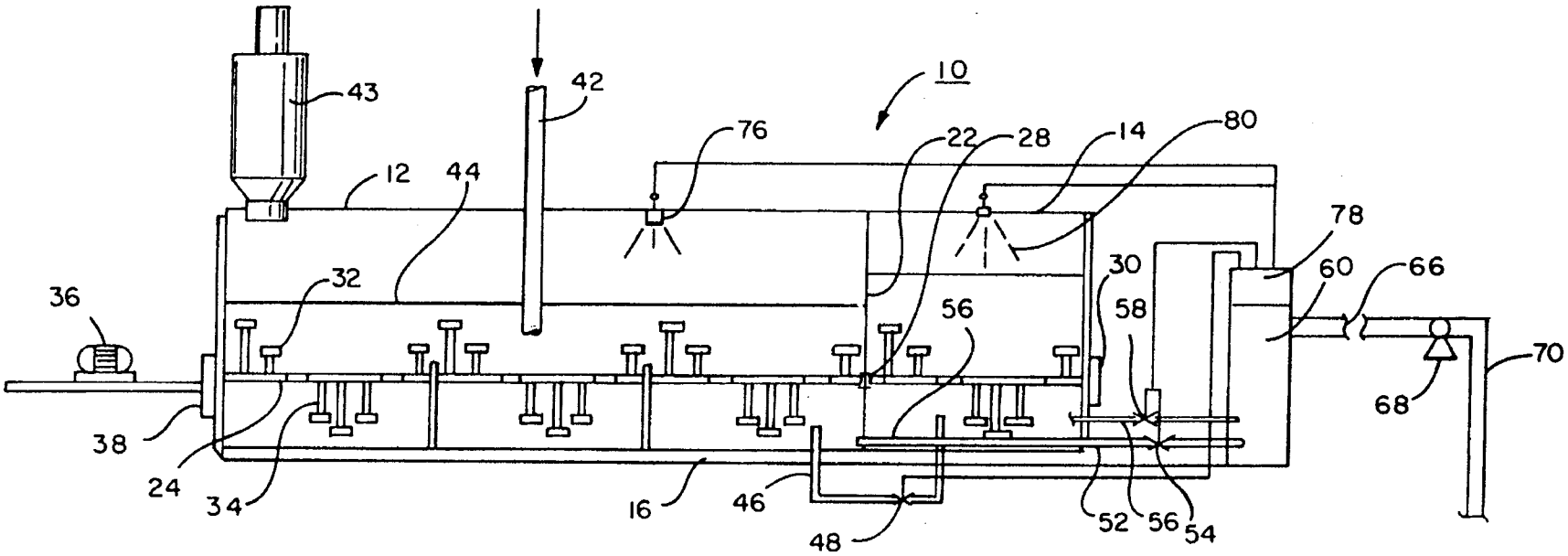
FIG. 3 is a partial cross sectional view, partly schematic, illustrating a mixing apparatus of the type used for slaking lime in water according to the method of the present invention.

Referring to FIG. 3, an improved apparatus 10 is shown which can be used to supply quicklime slurry on a continuous basis. While the description which follows describes a quicklime slaking operation, it will be understood that the apparatus could be used to slurry dry, hydrated lime, as well. The apparatus 10 has a primary tank 12 and an auxiliary tank 14 mounted on a frame structure 16. The apparatus 10 should be of legal highway size so that it can be transported on public roads or highways. The primary tank 12 should be large enough to process about 25 tons of dry quicklime, which is typically the maximum legal highway load for lime. A tank having a maximum capacity of 24,000 gallons is suitable to process 25 tons of dry quicklime. The auxiliary tank 14 has a capacity substantially less than that of the primary tank 12. A volume or capacity approximately one-third that of the primary tank 12 is sufficient for most operations. As an example, the tanks 12, 14 may be cylindrical tanks, each tank having a diameter of approximately 10.5 feet, with the primary tank 12 having a length of 30 feet and the auxiliary tank 14 having a length of 10 feet.

The frame structure 16 may be a skid on which the primary and auxiliary tanks 12 and 14 are mounted and which can be moved from place to place. Preferably, wheels (not shown) are mounted to the frame structure 16 to facilitate transporting the apparatus 10 to desired locations. As shown in FIG. 1, the primary and auxiliary tanks 12, 14 are concentric cylindrical tanks which are joined together and separated by a common wall 22. In the embodiment of FIG. 1, a single rotatable shaft 24 extends through both the primary and auxiliary tanks 12, 14 and through the common wall 22 which divides the primary and auxiliary tanks 12, 14. In other embodiments of the invention, each tank may be provided with a separate, individually operable mixing shaft. The rotatable shaft 24 is supported on bearings 28, 30 and 38. The bearing 28 located in the wall 22 is a sealed bearing which prevents fluid from escaping or flowing between the tanks 12, 14 through the wall 22.

Located along the length of the shaft 24, are a plurality of mixing paddles 32, 34. The paddles 32, 34 are arranged in a spiral pattern along the shaft. The paddles 32, 34 are angled to cause the particles of lime to flow along the length of the tanks 12, 14 and spirally intermix with the water. The paddles 32, 34 may be constructed of mild steel or any other suitably strong material and may be used in combination with flexible paddles, such as plastic, neoprene or other synthetic rubber. The paddles 32, 34 may also be belting having rubber around heat resistant fibers, like fiberglass fibers or the like. It is necessary that they be able to withstand the high temperatures which are often encountered in the slaking of quicklime. These temperatures may be near the boiling point of water.

The rotatable shaft 24 is rotated by means of a 100 horsepower electric motor 36 and conventional gearing. A rotational speed within the range of 30–90 revolutions per minute has been found to be satisfactory for mixing the lime slurry.

An inlet 42 is provided in the top of primary tank 12 and extends downward for a predetermined distance. After water is added to the tank 12 when forming the slurry, the inlet 42 will extend below a predetermined water level 44 for approximately 1 to 2 feet. Quicklime or hydrated lime may be introduced into the primary tank 12 through a feed hopper (not shown) or blown through a suitable pneumatic transport conduit (not shown) through the inlet conduit 42. A particulate scrubber 43 collects any dust in the tank space above water level 44. The introduction of the lime below the surface 44 of the water insures that the lime is thoroughly mixed and minimizes caking of the lime on the surface of the water.

The action of the mixing paddles 32 also insures that the slurry of lime is thoroughly slaked or mixed. The resulting reaction is highly exothermic with temperatures in the range from about 180° F. to 220° F., preferably below about 212° F. being reached. The lime slurry may then be introduced into the auxiliary tank 14 by means of a conduit 46 between and in communication with the primary and auxiliary tanks 12, 14. A valve 48 allows the conduit 46 to be selectively opened so that the lime slurry is introduced into the lime auxiliary tank 14. This may be accomplished without the use of a pump when the slurry level within the auxiliary is to be substantially the same as that in the primary tank. It may also be necessary to provide a pump in conjunction with the conduit 46 in order to pump the lime slurry to the auxiliary tank 14 if it is desirable that the lime slurry be at a higher level than that of the primary tank 12.

A suction line 52 with a valve 54 is provided with the primary tank 12 for drawing the lime slurry from the primary tank 12. The suction line 52 should have an inlet located at the bottom of the tank 12 to ensure complete drainage of the lime slurry. The auxiliary tank 14 also has a similar suction line 56 with a valve 58 for drawing lime slurry from the auxiliary tank 14. Both suction lines 52, 56 empty into a manifold 60. An effluent conduit 66 is provided with the manifold 60 for drawing a product stream from either the auxiliary or primary tanks 12, 14 through the manifold 60. A pump 68 pumps the effluent from the manifold 60 and conduit 66 to a conduit 70 where the product stream can be supplied to a desired area.

Provided with the primary tank 12 is an ultrasonic level indicator 76 which is electrically connected to the valves 54, 58 by process control unit 78. A level indicator 80 may also be provided with the auxiliary tank 14 and linked to the process control unit 78. The control unit 78 opens or closes the valves 54 and 58 to provide smooth and continuous effluent flow through the suction lines 52, 56, respectively. The control unit 78 may also connected to valve 48 on conduit 46.

In order to provide a continuous product stream of lime slurry, the apparatus 10 is transported to a desired area which is remote from a lime processing plant. Separate trucks or tanks are used to carry a supply of dry quicklime to be used in forming the lime slurry. Once the apparatus 10 is located at the remote job site, the primary tank 12 is filled with water through the inlet conduit 42 to the preselected level 44 from a suitable water source. When the primary tank 12 is filled with water, the quicklime may be blown or otherwise introduced into the primary tank 12. As this occurs, the water/lime mixture is stirred by means of the rotatable shaft 24 and the mixing paddles 32.

In forming lime slurries, the water used may vary in quality. Conventional water sources include city water mains, railroad storage facilities, highway department storage facilities, lakes, streams, and the like.

Typically, the amount of lime solids may range between 30–50% by weight to that of the total lime slurry. For example, 158,000 lbs. of water may be used to fill the tank to the preselected level 44. To this may be added 50,000 lbs. (25 tons) of lime. In a particularly preferred embodiment of the invention, the lime used is either a high calcium quicklime or a dolomitic quicklime. High calcium lime is usually preferable for most applications. The lime may have impurities but will ordinarily be greater than 90% calcium oxide.

In some cases, it may be desirable to add a soluble sulfate compound to the aqueous slaking medium contained within the mixing tank or to the quicklime prior to adding the quicklime to the slaking medium. Useful sulfate compounds include alkali metal and alkaline earth metal sulfates (e.g., potassium sulfate, calcium sulfate and sodium sulfate), organic sulfates (e.g., lignin sulphonate), sulfuric acid and mixtures thereof. Calcium sulfate can be added to the slaking medium in an amount ranging from about 0.5% to 5.0%, preferably about 1.0% to 2.0%, measured as a dry weight percent of the quicklime to be slaked.

Organic dispersants can also be added to the water prior to slaking or after slaking to lower the viscosity and increase the solids content of the slurry. Examples of suitable dispersants include the alkali metal salts of polyacrylic acid, for example sodium polyacrylate (SPAL) and potassium polyacrylate. However, due to the relative low cost and availability of sodium polyacrylate, sodium polyacrylate is a preferred dispersant. Other dispersing agents such as copolymers of polyacrylate are also effective. The amount of dispersing agent added is generally less than 1% by weight of quicklime preferably about 0.1–0.3% by weight.

Once mixing of the lime slurry within the primary tank 12 is complete, rotation of the shaft 24 may be stopped. The valve 48 on conduit 46 is then opened either manually or by means of the control unit 78 so that the lime slurry is introduced into the auxiliary tank 14. As discussed previously, the lime slurry may either be pumped into the auxiliary tank 14 or merely allowed to flow from the primary tank 12 into the auxiliary tank 14 until the fluid levels within each tank 12, 14, as measured by the level indicators 76, 80, equilibrates. Once this occurs, the control unit 78 causes the valve 48 to close so that the supply of lime slurry within the primary tank 12 is effectively cut off from the auxiliary tank 14. With the valve 48 closed, the valve 54 on the suction line 52 is opened and the pump 68 is activated so that a product stream of the lime slurry from the primary tank 12 is drawn into the manifold 60, through effluent conduit 66 and out conduit 70 to the selected area.

When the level of the slurry in the primary tank 12 drops to a level where the primary tank 12 is nearly empty, the control unit 78 shuts the valve 54 to close suction line 52 and simultaneously opens the valve 58 on suction line 56. The lime slurry within the auxiliary tank 14 is thus introduced into the manifold 60 and through conduits 66 and 70 to the selected area 74. Thus, an uninterrupted, continuous supply of lime slurry is supplied. It should be noted that while the product stream of lime slurry is being drawn from either the primary tank 12 or the auxiliary tank 14, the rotatable shaft 24 and mixing paddles 32 can be rotated periodically to further mix the slurry and prevent settling of the lime solids.

While the lime slurry is being drawn from the auxiliary tank 14, a second batch of water and lime is introduced into the primary tank 12 through conduit 42 and mixed as discussed previously. Once the lime slurry has been mixed in primary tank 12, the valve 48 is opened once again to allow the new lime slurry to flow into the auxiliary tank 14 while the lime slurry is still flowing from the auxiliary tank 14. When the auxiliary tank 14 is full, the valve 58 is shut and the valve 54 is opened so that a second product stream of lime slurry flows into the manifold 60 from the primary tank 12 where it is pumped through conduit 70 to the selected area. Alternatively, after the second lime slurry is formed in the primary tank 12, valve 58 can be shut and valve 54 opened so that the second product stream can be drawn from the primary tank 12 immediately after it is formed. Valve 48 is then opened so that the auxiliary tank 14 is filled with lime slurry from the primary tank 12 as the second product stream is being drawn from the primary tank 12.

Thus, a continuous product stream can be created by switching to the auxiliary tank 14 while mixing another batch of lime and water to form a new lime slurry. It is important that the amount of lime slurry added to the auxiliary tank 14 should be equal to at least the value of the flow rate of the lime slurry flowing out of the auxiliary tank 14 multiplied by the amount of time required to mix a new batch of water and lime slurry. Typically, the amount of time required to prepare a lime slurry using 25 tons of lime is about one and a half hours. Thus, for example, if a continuous product stream of 40 gallons/min of lime slurry are required, and it takes one and a half hours (90 min) to prepare a new batch of lime slurry in the primary tank 12, the auxiliary tank 14 would have to hold at least 3600 gallons of the lime slurry.

As has been previously mentioned, the high solids lime slurries of the invention can also be formed by slurrying dry, hydrated lime. For example, a lime slurry can be formed by mixing between about 40 to 55% by weight of hydrated lime with an amount of water and less than about 1% by weight preferably about 0.1 to 0.3% by weight, of a dispersing agent, based upon the weight of dry lime, to form a high solids slurry. The addition of dispersants allows the viscosity of lime slurry to be reduced. Examples of suitable dispersants used in forming hydrated lime slurries include the previously mentioned alkali metal salts of polyacrylic acid, for example sodium polyacrylate (SPAL) and potassium polyacrylate. However, due to the relative low cost and availability of sodium polyacrylate, sodium polyacrylate is a preferred dispersant. Other dispersing agents such as common phosphates, for example tetrasodium pyrophosphate (TSPP), could also be used. Preferably, the dispersing agent is added and mixed with the water prior to mixing with the hydrated lime. The viscosity reduction varies proportionally to the dispersant dose at treatment levels above 0.5%. Very low doses of sodium polyacrylate, below 0.5%, tend to change the viscosity of the slurry exponentially. Viscosities of 1000 cp or lower are adequate for treating aggregate in most applications.

By whatever method, the lime slurry produced for use in the present invention has a solids content between about 35–65% by weight, based on the total weight of aqueous slurry. The viscosity of the slurry is also generally about 1000 cp or less. The high solids slurry so produced can be added to the milled recycled asphalt pavement at any of several points between just prior to the initial processing of the road surface to just prior to the addition of the asphalt binder in the rejuvenation step 15. For example, a tank can be mounted on the paving machine or a tank truck can move alongside the milling machine to provide high solids lime slurry to the pulverization zone of the milling machine (step 13 in FIG. 1). In this way, the aggregate is uniformly coated with slurry as it is being crushed to the proper particle size.

Figure 2:
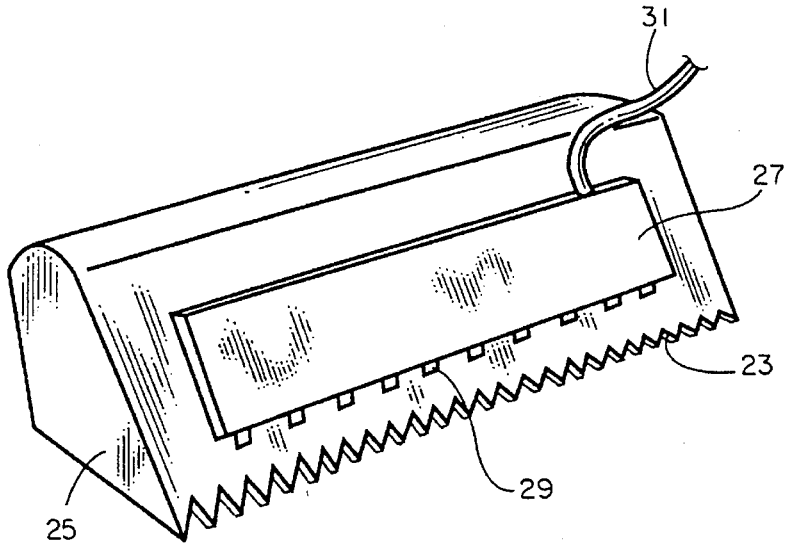
FIG. 2 is a partial, simplified view of the front end of the machine used to initially scrape and scarify the old pavement being recycled in the process of FIG. 1.

An added benefit of having a supply of lime slurry available is the use of high solids lime slurry as a lubricant to be applied to the teeth (23 in FIG. 2) of the scraping machine (a portion of which is shown as 25 in FIG. 2) which perform the initial scraping off or pulverization of the road surface. As shown in FIG. 2, a spray bar 27 having a plurality of nozzles 29 receives slurry being supplied through conduit 31. By distributing the lime slurry onto the road surface at the moment the teeth scrape off the top several inches of road surface, the lime slurry acts as a lubricant between the metal teeth and the asphalt pavement. The result is maximum mixing of the recycled asphalt pavement and lime.

The lime slurry can also be used to treat RAP where the RAP is taken to a central plant and crushed and treated with lime prior to returning it to the job site for re-incorporation into the asphalt roadway, or before taking the RAP to a hot mix plant for use as aggregate in a hot mix asphalt process.

An invention has been provided with several advantages. The use of a high solids lime slurry prepared by either slaking quicklime or by slurrying hydrated lime eliminates problems of dusting and mixing encountered with dry, hydrated lime. The use of a high solids, hot quicklime slurry minimizes the amount of added moisture which must be removed from the aggregate prior to combining the aggregate and binder. The higher temperature of the hot quicklime slurry decreases the viscosity of the slurry to provide improved mixing of the lime particles with the aggregate. The hot quicklime slurries of the invention have a higher solids content than did prior art quicklime slurries produced in conventional slaking operations. The use of a portable slaking apparatus eliminates the need for costly tanks, silos and mixing equipment at the job site or plant. The higher solids, hot quicklime slurry also decreases transportation costs for lime delivery to the job site. The lime slurry can be used as a lubricant for the teeth of the scraping machine used to remove the top several inches of the old road surface. By adding the slurry to the milling machine, it acts as a lubricant and provides optimum coating of the recycled aggregate. The use of a slurry allows the operator to more exactly meter the correct amount of lime slurry versus blending dry hydrate at the job site. The slurry of the invention can be provided as a continuous supply of slurry.

While the invention has been shown in only one of its forms, it is not thus limited but is susceptible to various changes and modifications without departing from the spirit thereof.

What is claimed is:

1. A method of recycling asphalt pavement by utilizing a portion of a top surface of an old roadway, the method comprising the steps of:

mixing together in a slurry mixing tank a lime component selected from the group consisting of unslaked quicklime and dry, hydrated lime and an aqueous slaking medium to form a high solids lime slurry, the resulting high solids lime slurry having a lime solids content greater than about 30% by weight, based upon the total weight of the slurry;

scraping up a portion of the top surface of the old roadway and collecting the scraped up portion;

treating the scraped up portion with the high solids lime slurry to produce a treated aggregate; and depositing the treated aggregate back onto the top surface of the old roadway.

2. The method of claim 1, wherein the lime solids content of the high solids lime slurry is in the range from about 35 to 60% by weight, based upon the total weight of the slurry.

3. The method of claim 2, wherein high solids lime slurry is made by slaking quicklime as the lime component and the quicklime slurry so produced is added to the collected top roadway portion when the quicklime slurry is at a temperature above ambient.

4. The method of claim 3, wherein the step of forming the quicklime slurry includes the step of adding a soluble sulfate compound to the slaking medium prior to contacting the quicklime with the slaking medium and then contacting the quicklime with the slaking medium to directly form a flowable and pumpable lime slurry having a solids content greater than 30% by weight.

5. The method of claim 4, wherein the aqueous slaking medium comprises water.

6. The method of claim 4, wherein the soluble sulfate compound comprises a member selected from the group consisting of alkali metal and alkaline earth sulfates, organic sulfates, sulfuric acid and mixtures thereof.

7. The method of claim 6, wherein the soluble sulfate is calcium sulfate which is added to the aqueous slaking medium in an amount ranging from about 0.5% to about 5% by weight, based upon the dry weight of the quicklime.

8. The method of claim 4, further comprising the step of adding an organic dispersant to lower the viscosity and increase the solids content of the slurry.

9. A method of recycling asphalt pavement by utilizing a portion of a top surface of an old roadway, the method comprising the steps of:

mixing together in a slurry mixing tank unslaked quicklime and an aqueous slaking medium to form a high solids quicklime slurry, the resulting high solids quicklime slurry having a lime solids content in the range from about 35 to 60% by weight, based upon the total weight of the high solids quicklime slurry;

scraping up a portion of the top surface of the old roadway and collecting the scraped up portion;

milling the scraped up portion to form an aggregate having a generally uniform particle size;

rejuvenating the milled aggregate by adding high solids quicklime slurry and mixing the aggregate and slurry;

depositing the rejuvenated aggregate back onto the old roadway surface;

compacting the aggregate to form a new roadway surface; and wherein the high solids lime slurry is made by slaking quicklime to form a hot quicklime slurry exothermic reaction and wherein the hot quicklime slurry so produced is added to the collected top surface of the old roadway while the slurry is at a temperature above ambient.

10. The method of claim 9, wherein the scraping step used to scrape up the top surface portion of the old roadway is accomplished by means of a scraping machine having scraping teeth thereon; and wherein the method further comprises the step of supplying high solids lime slurry to the scraping teeth of the scraping machine during the scraping step to lubricate the teeth.

11. A method of recycling asphalt pavement by utilizing a portion of a top surface of an old roadway, the method comprising the steps of:

mixing together in a slurry mixing tank unslaked quicklime and an aqueous slaking medium to form a high solids quicklime slurry, the resulting high solids quicklime slurry having a lime solids content greater than about 30% by weight, based upon the total weight of the high solids quicklime slurry;

scraping up a portion of the top surface of the old roadway and collecting the scraped up portion;

milling the scraped up portion to form an aggregate having a generally uniform particle size;

rejuvenating the milled aggregate by adding high solids quicklime slurry and mixing the aggregate and slurry;

depositing the rejuvenated aggregate back onto the old roadway surface;

compacting the aggregate to form a new roadway surface;

wherein the high solids lime slurry is continuously supplied to the process by means of a multiple tank slaking operation, further comprising the steps of:

a) mounting a primary tank and an auxiliary tank to a portable frame structure;

b) positioning the portable frame structure with the primary and auxiliary tanks at the selected area;

c) introducing a quantity of quicklime and water into the primary tank;

d) mixing the water and quicklime in the primary tank to form a hot quicklime slurry;

e) introducing into the auxiliary tank an amount of the quicklime slurry from the primary tank;

f) drawing a product stream of the quicklime slurry from the primary tank so that quicklime slurry is supplied to treat the collected top portion of the old roadway, the product stream being drawn until the amount of quicklime slurry within the primary tank drops to a preselected level; then g) drawing a second product stream of the quicklime slurry from the auxiliary tank so that quicklime slurry is continuously supplied to treat the collected top portion of the old roadway;

h) introducing a second quantity of quicklime and water into the primary tank and mixing the second quantity of quicklime and water to form a second quicklime slurry while the second product stream of quicklime slurry is being drawn from the auxiliary tank; and then i) repeating steps (e) through (h) until a desired amount of lime slurry is supplied for the recycling operation.

12. The method of claim 12, wherein:

step (e) includes introducing into the auxiliary tank an amount of quicklime slurry equal to at least the value of the volumetric flow rate of the second product stream of step (g) multiplied by the period of time required to complete step (h).

* * * * *